US007900621B2

(12) United States Patent
Al-Garni et al.

(10) Patent No.: US 7,900,621 B2
(45) Date of Patent: Mar. 8, 2011

(54) WATER ROCKET LAUNCH SYSTEM

(75) Inventors: Ahmed Z. Al-Garni, Dhahran (SA); Ayman M. Abdallah, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 165 days.

(21) Appl. No.: 12/453,437

(22) Filed: May 11, 2009

(65) Prior Publication Data

US 2010/0282228 A1 Nov. 11, 2010

(51) Int. Cl.
*F41B 11/00* (2006.01)
*A63H 27/26* (2006.01)

(52) U.S. Cl. ..... 124/56; 446/211

(58) Field of Classification Search ..... 124/56, 124/57, 61, 63, 69; 89/1.818; 446/211, 212, 446/56

See application file for complete search history.

(56) References Cited

U.S. PATENT DOCUMENTS

| | | | | |
|---|---|---|---|---|
| 2,609,811 | A | 9/1952 | Lawrence | |
| 2,720,818 | A | 10/1955 | Swipp et al. | |
| 2,927,398 | A * | 3/1960 | Kaye et al. | 446/212 |
| 3,091,052 | A * | 5/1963 | Ryan | 446/212 |
| 3,726,266 | A | 4/1973 | Palmer | |
| 3,962,818 | A * | 6/1976 | Pippin, Jr. | 446/212 |
| 4,223,472 | A | 9/1980 | Fekete et al. | |
| 5,188,557 | A * | 2/1993 | Brown | 446/212 |
| 5,415,152 | A | 5/1995 | Adamson et al. | |
| 5,415,153 | A | 5/1995 | Johnson et al. | |
| 5,535,729 | A | 7/1996 | Griffin et al. | |
| 5,839,940 | A * | 11/1998 | Ensmenger | 446/212 |
| 5,881,706 | A * | 3/1999 | Carson | 124/69 |
| 6,318,350 | B1 | 11/2001 | Williams | |
| 6,321,737 | B1 * | 11/2001 | Johnson et al. | 124/73 |
| 6,347,623 | B1 | 2/2002 | Kownacki et al. | |
| 6,460,531 | B1 * | 10/2002 | Gourley et al. | 124/64 |
| 6,532,948 | B2 | 3/2003 | Grichen | |
| 6,679,155 | B1 * | 1/2004 | Yaschur et al. | 89/1.813 |
| 6,945,495 | B1 * | 9/2005 | Lund et al. | 244/63 |
| 6,957,526 | B1 * | 10/2005 | Lin | 60/221 |
| 7,021,987 | B1 * | 4/2006 | Lund et al. | 446/212 |
| 7,297,043 | B2 | 11/2007 | Lam et al. | |
| 7,549,416 | B2 * | 6/2009 | Lin | 124/65 |
| 7,647,921 | B2 * | 1/2010 | Mullin | 124/56 |

FOREIGN PATENT DOCUMENTS

WO WO0151154 A2 7/2001

* cited by examiner

*Primary Examiner* — Troy Chambers
(74) *Attorney, Agent, or Firm* — Richard C. Litman

(57) ABSTRACT

The water rocket launch system is an automated system for launching multiple water rockets simultaneously with additional visual and auditory effects. The water rocket launch system includes a platform, with at least one launching base slidably mounted on an upper surface thereof. The at least one launching base is selectively and controllably driven to slide on the platform. At least one water rocket storage chamber is mounted on the platform, with the at least one water rocket storage chamber having an open interior region for receiving and storing a plurality of water rockets, and further having an open bottom end. A plurality of launching assemblies are mounted on the at least one launching base, so that the plurality of water rockets stored within the at least one water rocket storage chamber may be released thereon, with each launching assembly engaging and releasably supporting a respective one of the water rockets.

20 Claims, 3 Drawing Sheets

WATER ROCKET LAUNCH SYSTEM

BACKGROUND OF THE INVENTION

1. Field of the Invention

The present invention relates to toy rockets, and more particularly to a water rocket launch system for a plurality of water rocket toys.

2. Description of the Related Art

A water rocket is a type of model rocket using water as its reaction mass. The "pressure vessel" (i.e., the engine of the rocket) is a chamber which receives water held under pressure, and may be a finely machined vessel or, as is quite common in water rocketry, may be a used plastic soft drink bottle or the like. The water is forced out by a pressurized gas, typically compressed air. The pressure vessel, which is internal to the rocket, has a lower opening or nozzle for expelling the water. The pressure vessel is mostly filled with water and sealed. The vessel is then pressurized with a gas, typically air compressed from a bicycle pump, air compressor, pressurized air cylinder or the like, up to approximately 125 psi. Other gases, such as $CO_2$ or nitrogen, may also be used. The water and gas are used in combination, with the gas providing a means to store potential energy, as it is easily compressed, and the water increasing the mass fraction and providing greater momentum when ejected from the rocket's nozzle.

The seal on the nozzle of the rocket is then released and rapid expulsion of water occurs at high speeds until the propellant has been used up and the air pressure inside the rocket drops to atmospheric pressure. There is a net force created on the rocket in accordance with Newton's third law. The expulsion of the water can cause the rocket to fly a considerable distance into the air.

Simple water rockets, however, do not provide a great deal of visual entertainment. Other than the plume of water that is generated as the rocket is thrust upward, there is little to engage the senses of observers. It would be desirable to provide a water rocket system providing a wide array of entertainment and sensory input. Thus, a water rocket launch system solving the aforementioned problems is desired.

SUMMARY OF THE INVENTION

The water rocket launch system is an automated system for launching multiple water rocket toys simultaneously with additional visual and auditory effects. The water rocket launch system includes a platform having opposed upper and lower surfaces, with at least one launching base slidably mounted on the upper surface of the platform. The at least one launching base is selectively and controllably driven to slide on the platform.

At least one water rocket storage chamber is mounted on the upper surface of the platform, with the at least one water rocket storage chamber having an open interior region for receiving and storing a plurality of water rockets, and further having an open bottom end. A plurality of launching assemblies are mounted on an upper surface of the at least one launching base, such that the plurality of water rockets stored within the at least one water rocket storage chamber may be released onto the at least one launching base, with each launching assembly engaging and releasably supporting a respective one of the water rockets. The water rockets are selectively and controllably filled with water and pressurized gas for selective launching thereof.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
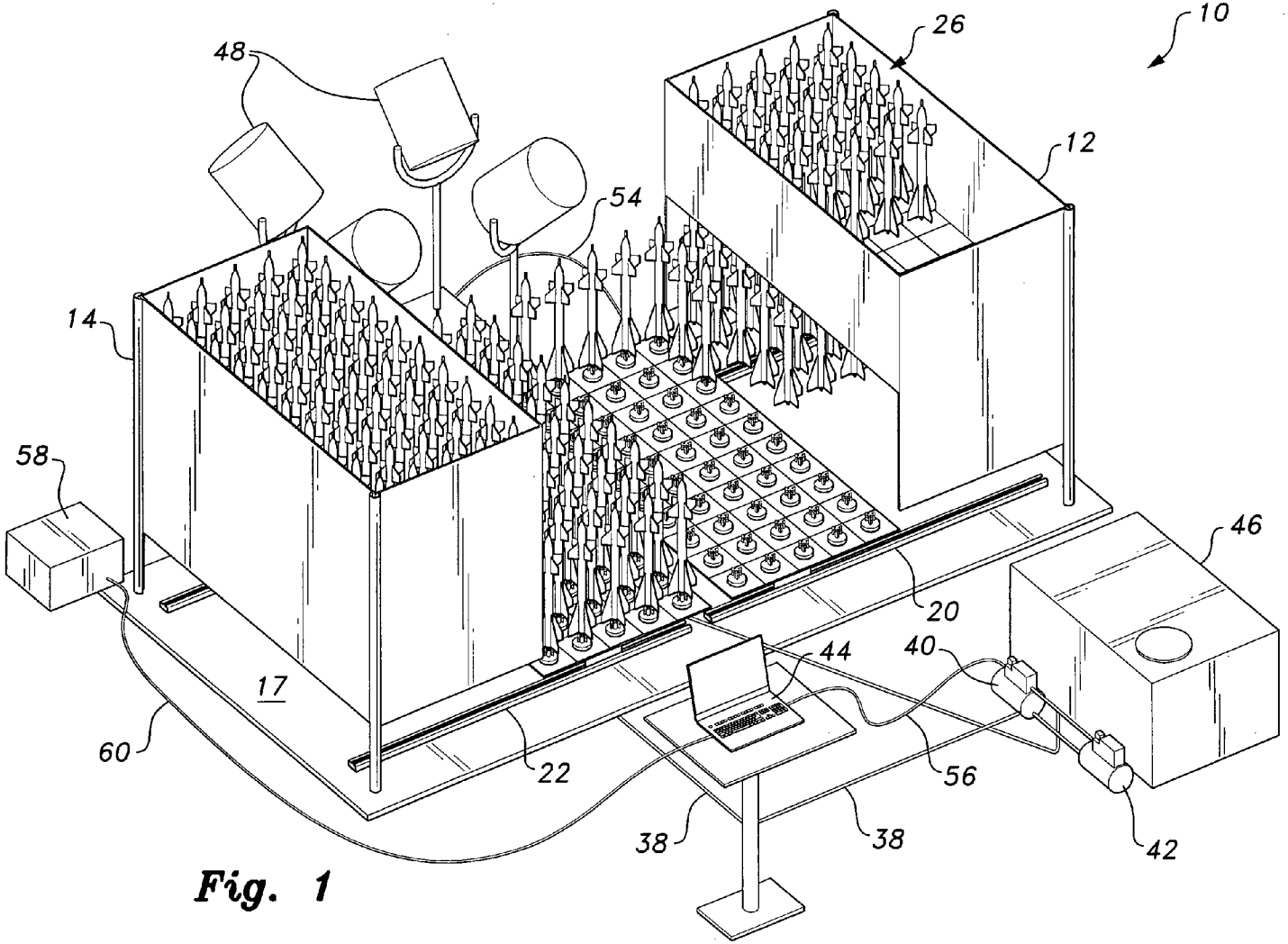
FIG. 1 is perspective view of a water rocket launch system according to the present invention.
Figure 2:
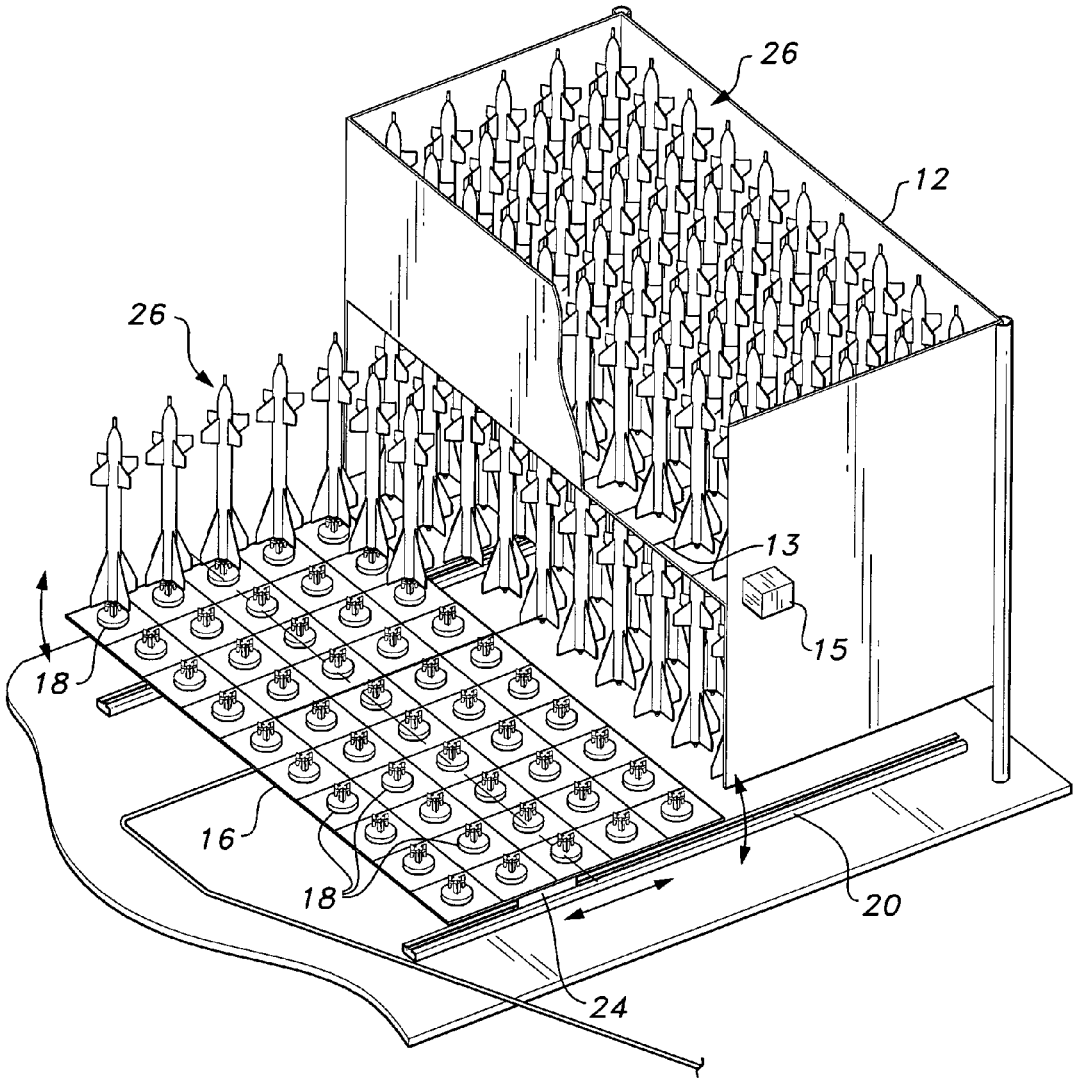
FIG. 2 is a partial perspective view of the water rocket launch system according to the present invention, showing further details thereof.

Now referring to FIGS. 1 and 2, a water rocket launch system 10 is shown. System 10 includes a pair of rocket storage chambers 12, 14 mounted on a platform 17. Preferably, as best shown in FIG. 2, each of storage chambers 12, 14 includes an inner wall 13, dividing each chamber into an upper region and a lower region. The inner wall 13 is segmented to support and hold a plurality of water rockets 26 in a selectable array pattern, both in the upper chamber and in the lower chamber. As shown, the lower, nozzle portions of each water rocket 26 are supported by, and releasably secured to, the upper surface of inner wall 13 in the upper chamber, and the upper nose portions of water rockets 26 are releasably held by the lower surface of inner wall 13. Any suitable type of support or clamping mechanism may be used to support water rockets 26 within storage chambers 12, 14. It should be understood that the contouring and relative dimensions of chambers 12, 14 are shown in the drawings for exemplary purposes only, and may be varied depending upon the number, type and configuration of the water rockets to be stored therein. The water rockets 26 stored within chambers 12, 14 are empty, i.e., their pressure vessels have not yet been filled with water or pressurized gas.

The platform 17 is a support having opposed upper and lower surfaces. The lower surface is adapted for resting on the ground or any other suitable support surface. A pair of sliding launching bases 16 are slidably mounted on the upper surface of platform 17. Each launching base 16 includes a plurality of launcher assemblies 12 mounted on an upper surface thereof, as best shown in FIG. 2. Two pairs of rails 20, 22, corresponding to each of the rocket storage chambers 14, 16, respectively, are mounted on the upper surface of platform 17, and each launching base 16 includes at least a pair of mounts 24 for slidably engaging the respective pair of rails 20, 22.

As indicated by the directional arrows in FIG. 2, each mount 24 allows the corresponding launching base 16 to be selectively and controllably linearly translated along the sliding rails, and each mount 24 is also preferably pivotal, allowing each launching base 16 to be selectively rotated with respect to platform 17. A drive system 58 is in communication with mounts 24 and selectively drives mounts 24 to linearly translate and pivot. Drive system 58 may be any suitable type of drive system capable of causing controllable linear translation of mounts 24 within rails 20, 22, such as a linear actuator, and further causing controllable rotation of mounts 24 with respect to platform 17, such as an additional electrical or pneumatic motor. Drive system 58 is in communication with a controller 44 (via line 60). Controller 44 may be any suitable type of computer, programmable logic controller or the like which allows the user to selectively actuate and control the drive system 58.

Controller 44 is further in communication with a release mechanism 15. In use, one or both of the launching bases 16 are driven by drive system 58, under control of controller 44, to slide beneath the open rocket storage chambers 12. Release mechanism then causes a selected number of water rockets 26, in a selected array pattern, to fall onto the corresponding base 16 such that nozzles of each rocket 26 (as will be described in greater detail below) land on, and are connected to, corresponding launch assemblies 18 which, as shown, are preferably arrayed in a grid pattern. Once all of the water rockets 26 stored in the lower portions of chambers 12, 14 have been used, the release mechanism can selectively release the inner wall 13, thus causing the water rockets 26 stored in the upper chambers to also fall.

Once each water rocket 26 is mounted in position and held by the corresponding launch assemblies 18, the launching bases 16, under the control of drive system 58 and controller 44, slides back to the central, open launching area, as shown in FIG. 1. As noted above, each launching base 16 is rotatable with respect to platform 17, allowing the user (via controller 44) to selectively direct the rockets 26 to a desired launch angle.

Figure 3:
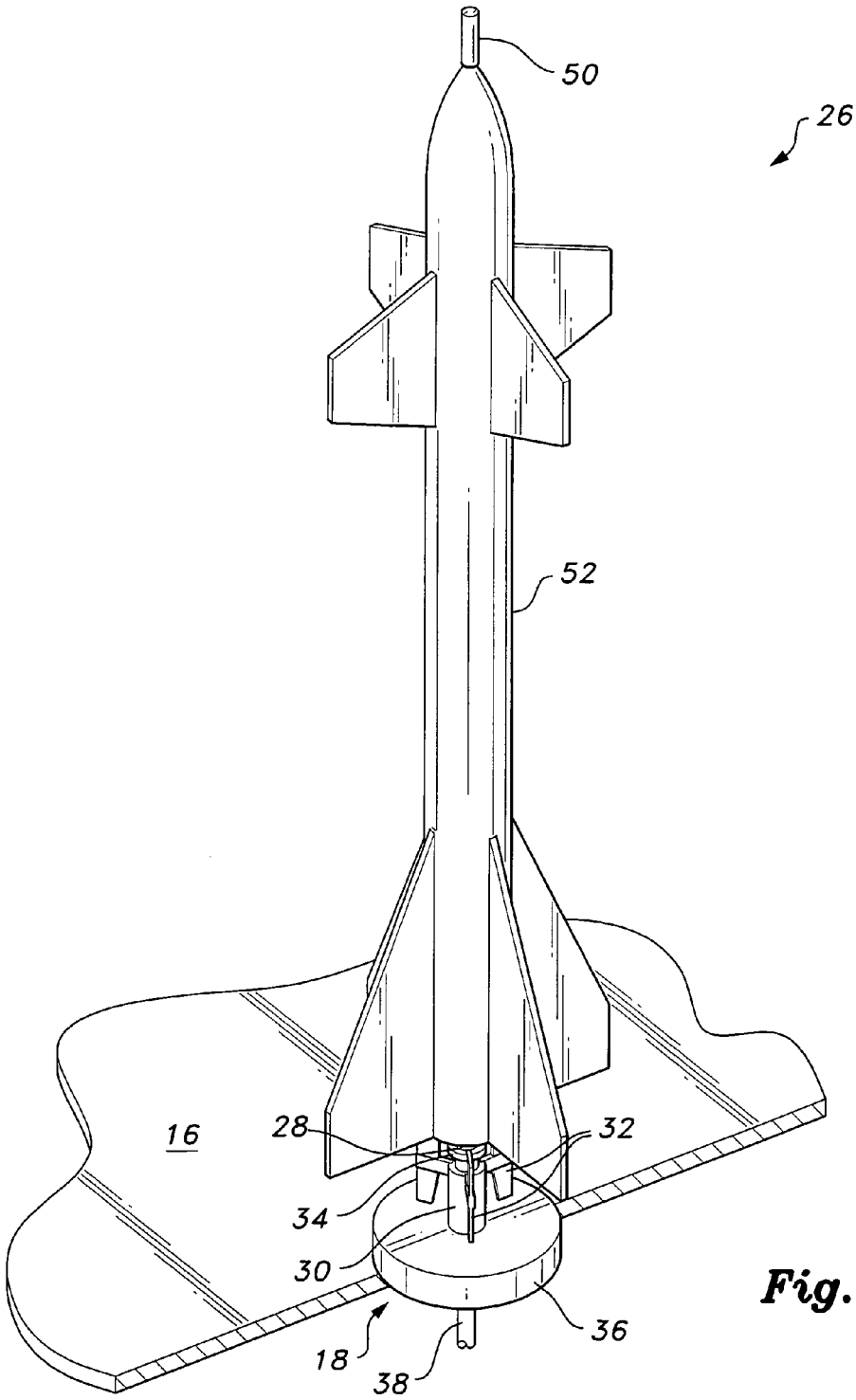
FIG. 3 is a perspective view of an individual rocket launch assembly of the water rocket launch system according to the present invention.

Referring to FIG. 3, when a rocket 26 is lowered onto a respective launch assembly 18, the lower nozzle 28 is received within a hollow launch mount 30. Each launch mount 30 is supported by a base 36, which rests on the upper surface of the launching base 16. Preferably, an annular flange 34 is formed about each nozzle 28, as shown, so that hooks or clamps 32, secured to launch mount 30, releasably engage the annular flange 34 to hold the water rocket 26 in place (and in the upright position) until time of launch.

Launch mount 30 may include an internal gasket or other seal such that a fluid-tight seal is formed when nozzle 28 is received therein. Launch mounts 30 are in fluid communication with a conduit 38, which is in communication with a pump 40 and an air compressor 42. Controller 44 is in communication with pump 40 and air compressor 42 (via line 56) to selectively control the pumping of water from water reservoir 46, via pump 40, through conduit 38 and into the pressure vessels of water rockets 26. Similarly, controller 44 selectively controls the transmission, at the same time, of pressurized air, via air compressor 42, through conduit 38, and into the water rockets 26.

Once fully pressurized, water rockets 26 are ready for launch. In order to enhance the sensory experience of the audience, each water rocket 26 preferably includes a whistle 50 mounted on the nose thereof, such that sounds are generated as the each rocket 26 flies through the air. Additionally, each rocket 26 is preferably coated with a phosphorescent material 52 to generate visual effects, particularly at night. Further, light projectors 48, which may be lasers, spotlights or the like, are in communication with controller 44 (via line 54), for illuminating the rockets 26 when they are flying in the air.

Under control of controller 44, once water rockets 26 are filled with water and pressurized air and are ready for launch, the hooks or clamps 32 are released by any suitable type of actuator mechanism in communication with controller 44, and the water rockets 26 launch.

It is to be understood that the present invention is not limited to the embodiments described above, but encompasses any and all embodiments within the scope of the following claims.

We claim:

1. A water rocket launch system, comprising:

a platform having opposed upper and lower surfaces;

at least one launching base slidably mounted on the upper surface of the platform;

means for selectively and controllably driving linear movement of the at least one launching base;

at least one water rocket storage chamber mounted on the upper surface of the platform, the at least one water rocket storage chamber having an open interior region for receiving and storing a plurality of water rockets, the chamber having an open bottom end;

a plurality of launching assemblies mounted on an upper surface of the at least one launching base;

means for releasing the plurality of water rockets stored within the at least one water rocket storage chamber onto the at least one launching base, each of the launching assemblies engaging and releasably supporting a respective one of the water rockets; and means for filling the plurality of water rockets with water and pressurized gas.

2. The water rocket launch system as recited in claim 1, further comprising at least one pair of rails mounted on the upper surface of said platform, said at least one launching base being slidably mounted on said at least one pair of rails.

3. The water rocket launch system as recited in claim 2, further comprising means for selectively and controllably pivoting said at least one launching base with respect to said platform.

4. The water rocket launch system as recited in claim 1, further comprising a water reservoir in fluid communication with said plurality of launching assemblies.

5. The water rocket launch system as recited in claim 4, further comprising a water pump in fluid communication with said water reservoir and said plurality of launching assemblies.

6. The water rocket launch system as recited in claim 5, further comprising an air compressor in fluid communication with said plurality of launching assemblies.

7. The water rocket launch system as recited in claim 6, further comprising means for selectively and controllably actuating said water pump and said air compressor to fill said plurality of water rockets with said water and said pressurized gas.

8. The water rocket launch system as recited in claim 7, wherein each said launching assembly comprises:

a base mounted on the upper surface of said at least one launching base; and a hollow launch mount having an open upper end adapted for slidably receiving a nozzle of a respective one of said plurality of water rockets.

9. The water rocket launch system as recited in claim 8, wherein an annular flange is formed about the nozzle of each of said plurality of water rockets.

10. The water rocket launch system as recited in claim 9, further comprising means for releasably locking the annular flange of each said nozzle to a respective one of said hollow launch mounts.

11. The water rocket launch system as recited in claim 1, further comprising at least one light source for selectively illuminating said plurality of water rockets.

12. The water rocket launch system as recited in claim 11, wherein each said water rocket is coated with a phosphorescent material.

13. The water rocket launch system as recited in claim 1, wherein each said water rocket has a whistle secured thereto.

14. The water rocket launch system as recited in claim 1, wherein said at least one water rocket storage chamber includes an inner wall dividing said at least one water rocket storage chamber into upper and lower storage regions.

15. The water rocket launch system as recited in claim 14, further comprising means for releasably mounting said plurality of water rockets to said inner wall.

16. A water rocket launch system, comprising:

a platform having opposed upper and lower surfaces;

at least one launching base slidably mounted on the upper surface of the platform;

means for selectively and controllably driving linear movement of the at least one launching base;

at least one water rocket storage chamber mounted on the upper surface of the platform, the at least one water rocket storage chamber having an open interior region for receiving and storing a plurality of water rockets, the chamber having an open bottom end;

a plurality of launching assemblies mounted on an upper surface of the at least one launching base;

at least one pair of rails mounted on the upper surface of the platform, the at least one launching base being slidably mounted on the at least one pair of rails;

means for selectively and controllably pivoting the at least one launching base with respect to the platform;

means for releasing the plurality of water rockets stored within the at least one water rocket storage chamber onto the at least one launching base, each of the launching assemblies engaging and releasably supporting a respective one of the water rockets; and means for filling the plurality of water rockets with water and pressurized gas.

17. The water rocket launch system as recited in claim 16, further comprising:

a water reservoir in fluid communication with said plurality of launching assemblies;

a water pump in fluid communication with said water reservoir and said plurality of launching assemblies;

an air compressor in fluid communication with said plurality of launching assemblies; and means for selectively and controllably actuating said water pump and said air compressor to fill said plurality of water rockets with said water and said pressurized gas.

18. The water rocket launch system as recited in claim 17, wherein each said launching assembly comprises:

a base mounted on the upper surface of said at least one launching base; and a hollow launch mount having an open upper end adapted for slidably receiving a nozzle of a respective one of said plurality of water rockets.

19. The water rocket launch system as recited in claim 18, wherein an annular flange is formed about the nozzle of each of said water rocket.

20. The water rocket launch system as recited in claim 19, further comprising means for releasably locking the annular flange of each said nozzle to a respective one of said hollow launch mounts.

* * * * *